United States Patent [19]

Liu

[11] Patent Number: 4,614,479

[45] Date of Patent: Sep. 30, 1986

[54] ADJUSTABLE AUTOMATICALLY CONTROLLED PNEUMATIC PUMP DEVICE

[76] Inventor: Jackson Liu, No. 200, Chien Kuo Rd., Sec. 3, Min Hsiung Hsiang, Chiayi Hsien, Taiwan

[21] Appl. No.: 785,079

[22] Filed: Oct. 7, 1985

Related U.S. Application Data

[63] Continuation-in-part of Ser. No. 602,228, Apr. 19, 1984, abandoned.

[51] Int. Cl.[4] ..... F04B 49/06; F04B 21/00

[52] U.S. Cl. ..... 417/44; 417/33; 417/63; 417/234; 417/411; 417/415; 152/415; 137/224; 137/227; 318/481; 307/118

[58] Field of Search ..... 417/33, 38, 44, 63, 417/234, 410, 411, 415; 137/224, 227; 152/415; 141/38; 318/481; 307/118

[56] References Cited

U.S. PATENT DOCUMENTS

| | | | |
|---|---|---|---|
| 1,081,693 | 12/1913 | Parker | 137/224 X |
| 1,234,130 | 7/1917 | Cartwright | 417/415 |
| 1,247,623 | 11/1917 | Black et al. | 417/63 |
| 1,647,818 | 11/1927 | Semak | 417/411 X |
| 2,010,062 | 8/1935 | Dawson | 417/44 X |
| 2,359,955 | 10/1944 | Whitenack | 318/481 X |
| 2,741,987 | 4/1956 | Murphy et al. | 417/44 X |
| 3,143,969 | 8/1964 | Eames et al. | 417/63 X |
| 4,080,105 | 3/1978 | Connell | 417/33 X |
| 4,164,664 | 8/1979 | Kasiewicz | 307/118 |
| 4,187,058 | 2/1980 | Fish | 417/234 |
| 4,389,166 | 6/1983 | Harvey et al. | 417/234 |

FOREIGN PATENT DOCUMENTS

| | | | |
|---|---|---|---|
| 1209900 | 1/1966 | Fed. Rep. of Germany | 137/227 |
| 2320766 | 11/1974 | Fed. Rep. of Germany | 307/118 |
| 1046457 | 7/1953 | France | 152/415 |

*Primary Examiner*—William L. Freeh
*Assistant Examiner*—Paul F. Neils
*Attorney, Agent, or Firm*—Ladas & Parry

[57] ABSTRACT

An adjustable automatically controlled pneumatic pump device includes an air pump, an electric motor adapted for being energized by a power source to drive the air pump, an air hose member with an exhaust port at one end, and an other end of the hose member connected to the air pump, a pressure gauge with a pressure setting pointer which can be adjusted in advance according to the predetermined air pressure desired and a pressure indicating pointer which is capable of contacting with the pressure setting pointer when the air pressure through the air hose reaches the predetermined air pressure, and an electric logic circuit device which is electrically associated with the motor and the pressure gauge and arranged in that the electric logic circuit can control the motor for pumping air into an enclosed space.

3 Claims, 7 Drawing Figures

ADJUSTABLE AUTOMATICALLY CONTROLLED PNEUMATIC PUMP DEVICE

This application is a continuation-in-part of application Ser. No. 602228 filed on Apr. 19, 1984 now abandoned.

BACKGROUND OF THE INVENTION

This invention relates to an adjustable automatically controlled pneumatic pump device for automatically inflating tires or any enclosed space. More specifically, the invention has a pressure gauge and electronic logic controlled circuit which form part of an automatic tire-inflating apparatus, which is itself specifically designed to automatically pump air into a tire or any enclosed space under control of the pressure gauge to ensure that the pressure of air in the tire or enclosed space does not exceed a desired inflation limit. This invention is an improvement over the pneumatic pump device disclosd in my prior application Ser. No. 602228 filed on Apr. 19, 1984.

In the pneumatic pump device of my prior application mentioned, there are an electric motor adapted for connecting to a power source, an air pump driven by the electric motor, a tube member joined with the air pump, terminating in an outlet opening adapted to communicate with the enclosed space to be inflated, a means for measuring the pressure in the tube member being communicated with the tube member, a pressure sensing member associated with the means, displaceable proportionally with the pressure being measured during the operation of the pneumatic pump, a relay electrically associated with the motor and the pressure sensing member, and adapted to connect to the power source, including a set of contacts which can be opened when a predetermined extent of displacement of the pressure sensing member is achieved.

The pneumatic pump device of my prior, above mentioned application has a more complicated controlled circuit and venting mechanism than does the invention described below.

SUMMARY OF THE INVENTION

The primary object of the present invention is to provide an inflating apparatus which is simple in construction and contains a compact electronic controlled circuit which will avoid the deficiencies and disadvantages of the apparatus of my prior application.

In order to achieve the aforesaid object as well as other incidental objects and advantages, the present invention includes a housing, an air pump mounted in said housing, an electric motor adapted for being energized by a power source to drive the air pump, and an air hose member of which one end contains an exhaust port and the other end is connected to the air pump.

The invention further includes a bourdon-tube pressure gauge, communicated with the air hose member, for measuring the pressure in the air hose member. The pressure gauge has a pressure indicating pointer, a pressure setting pointer, a curved-spring tube and a pull rod. The pressure measurement of the gauge is based on the deformation of the curved-spring tube (an elastic measuring element) by the pressure to be measured, which is in the air hose member. The deformation is indicated by the pressure indicating pointer on a dial calibrated to give pressure readings. The tube, which is of oval cross-sectional shape, is closed at one end, and the pressure to be measured is applied to the other end through the air hose member, causing the radius of curvature of the tube to increase. (i.e., the tube tends to straighten itself out.) The pressure setting pointer can be adjusted in advance according to the air pressure desired. The pressure indicating pointer can be displaced proportionally with the pressure being measured in the air hose during the operation of the adjustable pneumatic pump device because of the above-described arrangement, the pressure indicating pointer being capable of contacting with the pressure setting pointer when the air pressure through the air hose reaches the predetermined air pressure.

The invention still further includes an electronic logic circuit device electrically associated with the motor, the pressure setting pointer and the pressure indicating pointer of the pressure gauge, and adapted to be connected to the power source, including an amplified circuit, a relay and a positive-logic cross-coupled NANDS device, wherein an electric signal can flow into the positive-logic cross-coupled NANDS device when the pressure indicating pointer contacts the pressure setting point so that the positive-logic cross-coupled NANDS device functions as a RS flip-flop at its output end and puts out a normal output signal for actuating the relay and stopping the motor, responsive to the electric signal. The amplified circuit connected to the output end of the positive-logic cross-coupled NANDS device amplifies the normal output signal for determining whether the amplified circuit device is in ON or OFF condition.

The relay includes a normally open contact switch electrically associated with the motor and amplified circuit device, whereby the normally open contact switch is in closed condition or open condition for controlling the motor, responsive to the ON or OFF condition of the amplified circuit device resulting from the normal output signal of the positive-logic cross-coupled NANDS device, so that the adjustable pneumatic pump device can be automatically controlled by the electric logic circuit device.

BRIEF DESCRIPTION OF THE DRAWINGS

Other and further objects and advantages of this invention will become apparent to those skilled in the art from a consideration of the following detailed description of the preferred embodiments with reference to the accompanying drawings, wherein.

DETAILED DESCRIPTION OF THE INVENTION

The following is a detailed description of the best presently contemplated embodiment of the invention. This description is not to be taken in a limiting sense, but is make merely for the purpose of illustrating the general priciples of the invention.

Figure 1:
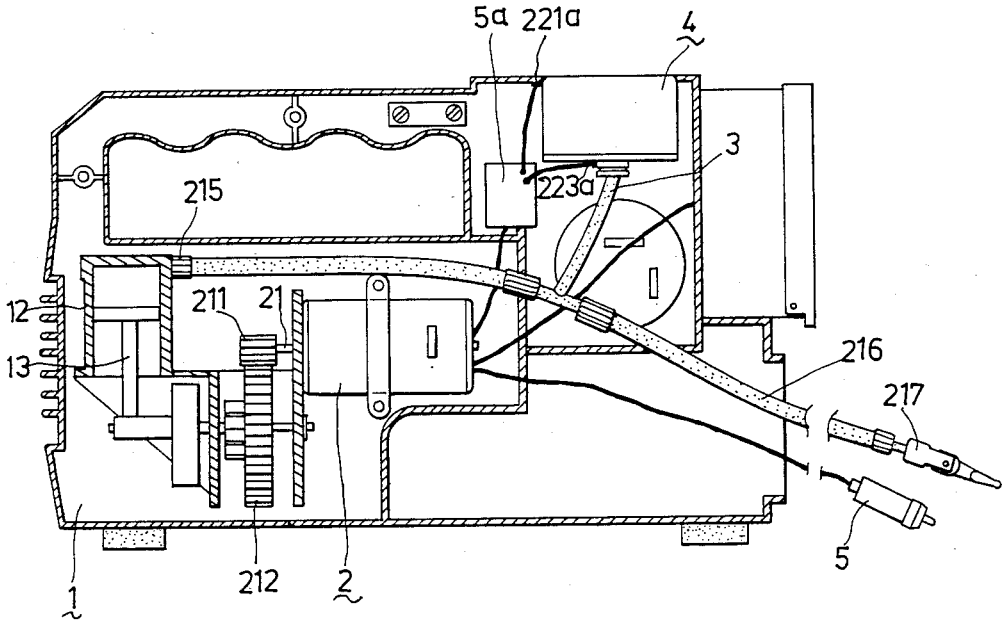
FIG. 1 is a schematic view showing the inner structure of an embodiment of the air inflating pump device according to the present invention.
Figure 2:
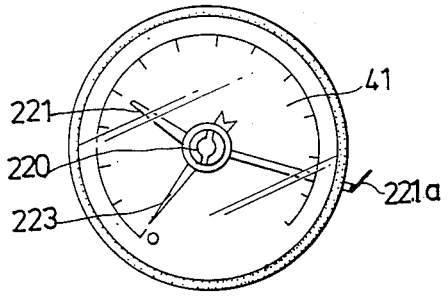
FIG. 2 is a top view of the calibrated dial associated with a pressure setting pointer and a pressure indicating pointer of the pressure gauge according to the invention.
Figure 3:
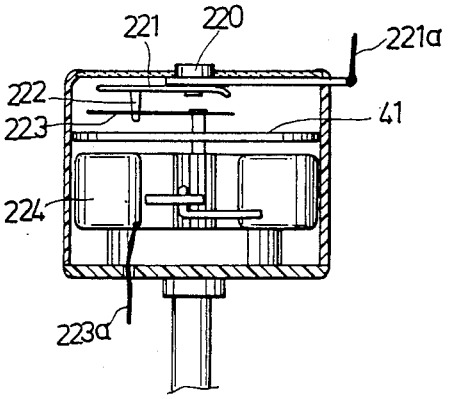
FIG. 3 is a schematic view showing the position of the two pointers when they are contacting each other.
Figure 5:
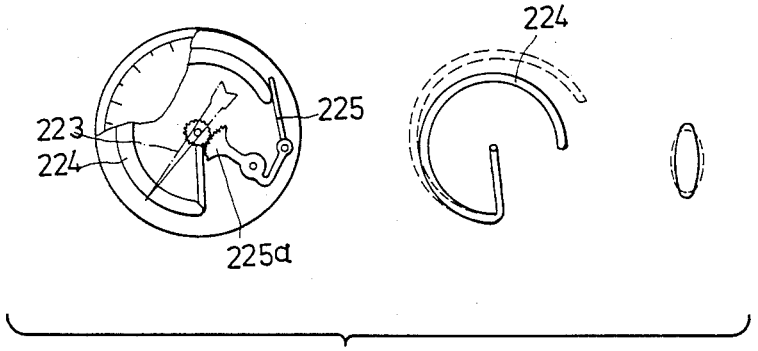
FIG. 5 is a schematic and cross-sectional view of the curved-spring tube in the pressure gauge showing that the tube tends to straighten itself and cause the radius of the curvature of the tube to increase proportionally to the increased air pressure in the hose member.
Figure 4:
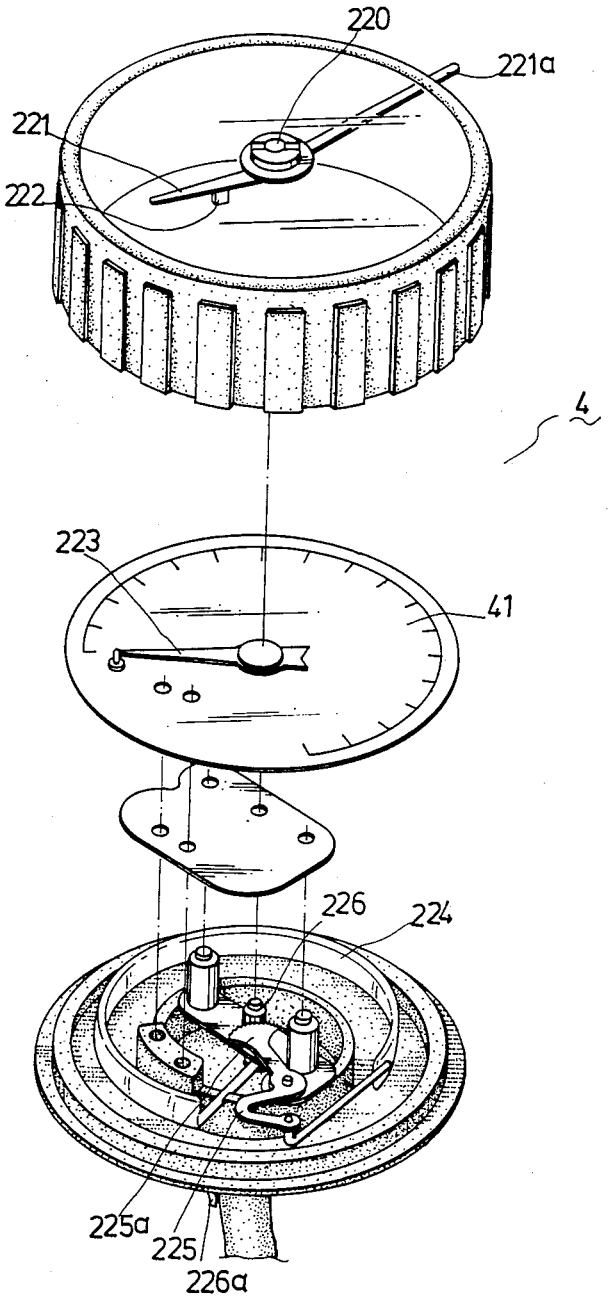
FIG. 4 is an exploded view of the pressure gauge according to the invention.

Referring to FIG. 1, the invention provides a housing 1, an air pump 12 with piston 13 mounted in the housing 1, a driving mechanism including an electric motor 2 adapted for being energized by a power source (for instance, a cigarette lighter source) through a plug 5 to drive the air pump 12, a small gear 211 connecting to the motor 2 through a pivot 21 and a larger gear 212 engaging to the small gear 211 for driving the air pump 12, and an air hose member 216 with an exhaust port 217 at one end, the other end of the air hose member 216 connected to the air pump 12 through a hole 215.

Referring to FIG. 1 in conjunction with FIG. 2, FIG. 3, FIG. 4 and FIG. 5, the invention further includes a bourdon-type pressure gauge 4 for measuring the pressure in the air hose member 216 being communicated with the air hose member through a pipe 3. The pressure gauge 4 has a dial 41, a pressure setting pointer 221 with a contact member 222 at its one end and connecting pviotally with an adjustable knob 220 and a contact end 221*a*, and a pressure indicating pointer 223 on the dial. The gauge 4 further includes a curved-spring tube 224 and a pull rod 225. The pressure measurement of the gauge 4 is based on the deformation of the curved-spring tube 224 (i.e., an elastic measuring element) by the pressure to be measured. The deformation is indicated by the pressure indicating pointer 223 on the dial 41 calibrated to give pressure readings. The curved tube 224 is of oval cross-sectional shape and closed at one end, and the pressure to be measured (i.e., the pressure in the hose member 216) is applied to the other end, causing the radius of curvature of the tube 224 to increase (i.e., the tube 224 tends to straighten itself out, as shown in the dotted lines in FIG. 5). The pressure indicating pointer 223 pivotally connects to a small gear 226 and the pull rod 225 connects to the closed end of the curved tube 224. The pull rod 225 further includes a toothed end 225*a* engaged with the small gear 226 so that the pressure indicating pointer 223 gives pressure readings proportional to the increased radius of the curvature of the curved tube 224. A contact member 223*a* at the bottom of the gauge 4 is designed to connect with the pressure indicating pointer 223.

The setting pointer 221 can be adjusted in advance by the knob 220 according to the air pressure desired, and the pressure indicating pointer 223 is capable of contacting with the contact member 222 of the pressure setting pointer 221 when the air pressure through the air hose member 216 reaches the predetermined air pressure.

Figure 6:
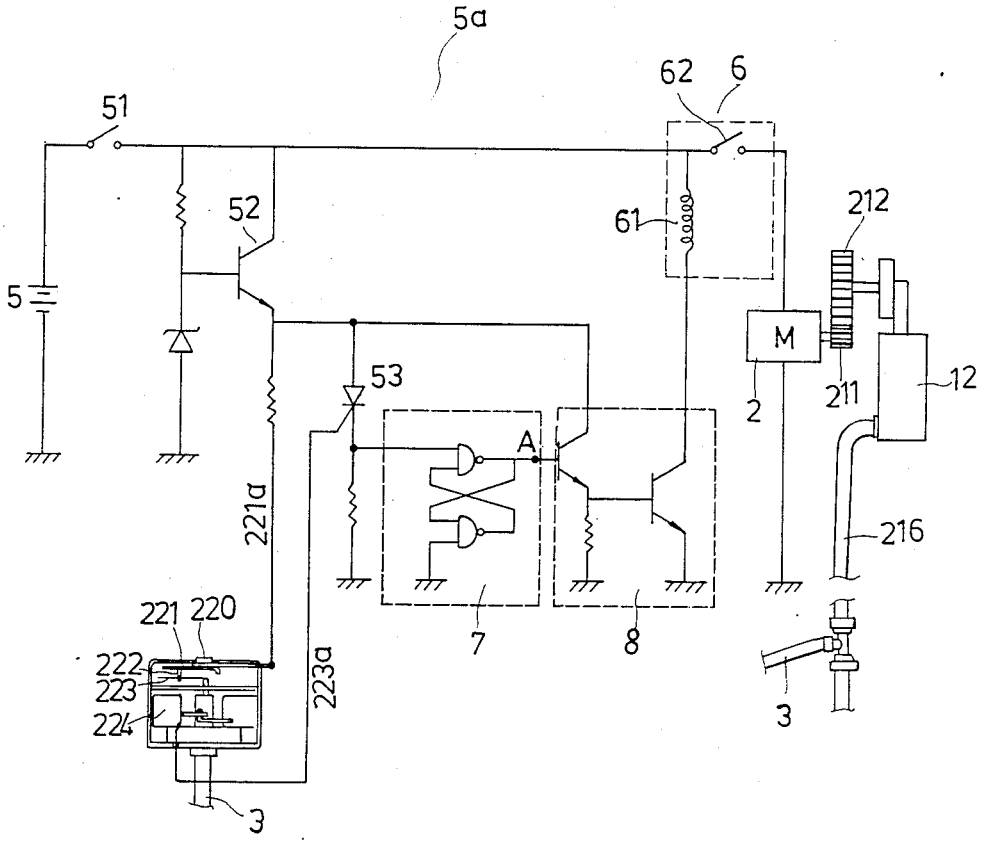
FIG. 6 is an electric logic circuit for controlling the inflating pump device according to the invention.
Figure 7:
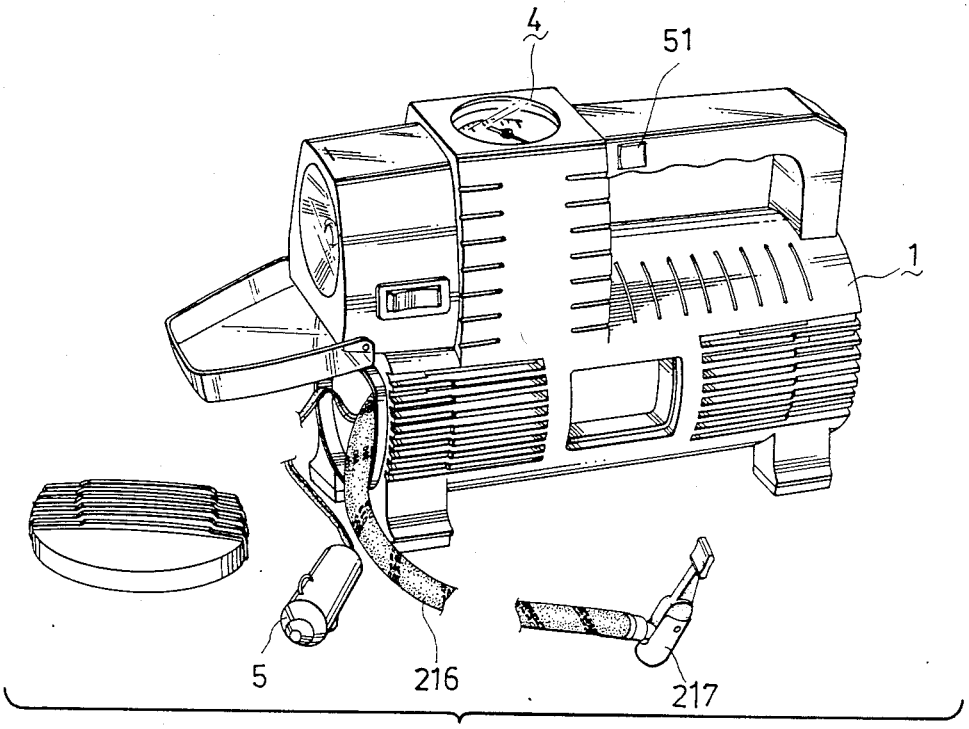
FIG. 7 is a perspective view of the invention.

Referring to FIG. 6, the invention still further includes an electronic logic circuit device 5*a* electrically associated with the motor 2, the contact end 221*a* of the pressure setting pointer 221 and the contact member 223*a* of the pressure indicating pointer 223, and adapted to be connected to the power source (an automobile cigarette lighter) through the plug 5.

The electronic logic circuit device includes a switch 51, a transistor 52, a SCR 53, a relay 6 with a coil 61 and normally open contact switch 62, a positive-logic cross-couple NANDS device 7 and an amplified circuit 8, wherein when the switch 51 is on, the current through the transistor 52 and amplified circuit form a current loop and actuate the coil 61 and closing the normally open contact 62 to start the motor 2 and inflate the tire or enclosed space.

When the air pressure reaches the predetermined pressure, the pressure indicating pointer 223 of the gauge 4 contacts the pointer 221 through the contact member 222. Then an electric signal can flow into the SCR 53 through the contact end 221*a* and 223*a* to actuate the SCR 53 so that the current flows through the SCR 53 and the positive-logic cross-couple NANDS device 7. The positive-logic cross-couple NANDS device 7 functions as a RS flip-flop at its output end A and produces a normal output signal responsive to the electric signal. The amplified circuit 8 connects to the output end A of the positive-logic cross-coupled NANDS 7 device to amplify the normal output signal to determine the amplified circuit 8 to be in ON or OFF condition. When the SCR 53 being actuated, (i.e., when the pressure indicating pointer 223 contacts with the pressure setting pointer 221), the amplified circuit device 8 turns off so that no current flow through the relay 6 and the coil 61 is deactuated. Then the normally open contact switch 62, opens and stops the motor 2 from pumping air into the air hose member 216.

By the above-described arrangement, the adjustable pneumatic pump device can be automatically controlled by the electric logic cirucit device.

While this invention has been described with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

I claim:

1. An adjustable automatically controlled pneumatic pump device comprising:

a housing;

an air pump mounted in said housing;

an electric motor adapted for being energized by a power source to drive said air pump;

an air hose member having an exhaust port at one end, and another end of said hose member connected to said air pump;

a pressure gauge for measuring the pressure in said air hose member which is communicated with said air hose member; said pressure gauge having a pressure indicating pointer and a pressure setting pointer, wherein, said pressure indicating pointer can be displaced proportionally with the pressure being measured during the operation of said adjustable pneumatic pump device, and said pressure setting member can be adjusted in advance according to the predetermined air pressure desired; said pressure indicating pointer being capable of contacting with said pressure setting pointer when the air pressure through said air hose reaches said predetermined air pressure; and an electric logic circuit device electrically associated with said motor, said pressure setting pointer and said pressure indicating pointer of the pressure gauge, and adapted to be connected to the power source, including an amplified circuit, a relay and a positive-logic cross-coupled NANDS device;

wherein an electrical signal can flow into said positive-logic cross-coupled NANDS device when said pressure indicating pointer contacts with said pressure setting pointer so that said positive-logic cross-coupled NANDS device functions as an RS flip-flop at its output end and produces a normal output signal for actuating said relay and stopping said motor, responsive to said electric signal; said amplified circuit connecting to said output signal to determine said amplified circuit device to be in ON or OFF condition.

2. An adjustable automatically controlled pneumatic pump device as claimed in claim 1, in which said relay includes a normally open contact switch electrically associated with said motor and amplified circuit device, whereby said normally open contact switch changes between closed condition and open condition for controlling said motor, responsive to said ON or OFF condition of said amplified circuit device resulting from said normal output signal of said positive-logic cross-coupled NANDS device.

3. An adjustable automatically controlled pneumatic pump device as claimed in claim 1, wherein said pressure gauge further includes a curved tube with a closed end and an other end communicated to said air hose member, whereby when the pressure to be measured is applied to said tube through said air hose member, the radius of curvature of said tube increases and said pressure indicating pointer gives a pressure reading in response to the deformation of said tube.

* * * * *